United States Patent [19]

Clarke et al.

[11] 4,137,747

[45] Feb. 6, 1979

[54] COLLECTOR FOR BROKEN-OFF FASTENER PARTS

[75] Inventors: Ronald L. C. Clarke; Donald S. Savage, both of St. Albans, England

[73] Assignee: Aerpat A.G., Zug, Switzerland

[21] Appl. No.: 888,497

[22] Filed: Mar. 20, 1978

[30] Foreign Application Priority Data

Mar. 22, 1977 [GB] United Kingdom ..... 12125/77

[51] Int. Cl.[2] ..... B21J 15/34

[52] U.S. Cl. ..... 72/391; 29/243.53

[58] Field of Search ..... 72/391; 29/243.53, 243.54

[56] References Cited

U.S. PATENT DOCUMENTS

| | | | |
|---|---|---|---|
| 3,196,662 | 7/1965 | Simmons | 72/391 |
| 3,254,522 | 6/1966 | Elliott | 72/391 |
| 3,329,000 | 7/1967 | Schwab | 72/391 |
| 3,410,128 | 11/1968 | Sauter | 72/391 |
| 3,415,102 | 12/1968 | Elliott | 72/391 |
| 3,457,763 | 7/1969 | Freeman | 72/391 |

*Primary Examiner*—C. W. Lanham
*Assistant Examiner*—Gene P. Crosby
*Attorney, Agent, or Firm*—Oblon, Fisher, Spivak, McClelland & Maier

[57] ABSTRACT

A collector for the broken-off stems of blind rivets consists of a cylindrical container (20) secured to the rear of the riveting gun head (11). A cylindrical cover (22) closely surrounds the container end and is rotatable around it to a limited extent. The container (20) has an aperture (21), and the cover (22) has a corresponding aperture (23), the cover being biassed by a spring (24) to keep the apertures non-aligned. The cover (22) is rotated by means of a grip (38, 39) to bring the two apertures (21, 23) into alignment to discharge stems from the collector, the aperture (21) being closed automatically by the spring (24) on release of the cover. The container and cover may be of transparent material.

13 Claims, 5 Drawing Figures

COLLECTOR FOR BROKEN-OFF FASTENER PARTS

The present invention relates to a collector for broken-off fastener parts produced by operation of fastener-installation apparatus; for example, the broken-off stems of blind rivets produced by a blind-riveting tool.

The present invention provides a collector for broken-off fastener parts produced by the operation of fastener-installation apparatus which collector comprises; a container attachable to or incorporated in the installation apparatus to receive broken-off fastener parts from the installation apparatus; the container having an aperture; closure means normally overlying and closing the aperture and temporarily operable, without detaching the closure means, to allow removal or discharge through the aperture of broken-off parts accumulated in the container.

Preferably the closure means is biassed to close the aperture. Preferably the closure means is operable by relative sliding movement between the closure means and the container.

The invention also provides a collector as aforesaid, in which the container and the closure means are of generally similar configuration and one is housed within the other, and the closure means is provided with an aperture corresponding the aperture in the container, the two apertures being normally non-aligned and being brought into alignment by relative sliding movement between the container and the closure member.

Preferably the relative sliding movement comprises rotational movement. Preferably the container comprises a cylindrical wall in which the aperture is provided, and in which the closure means also comprises a cylindrical wall.

Preferably the container comprises a cylindrical wall in which the aperture is provided, and in which the closure means also comprises a cylindrical wall, the two cylindrical walls being aligned with a common axis, and in which the relative sliding movement comprises relative rotational movement between the container and the closure means about the common axis.

Preferably the closure member is provided with grip means to facilitate operation thereof.

The invention also provides a collector as aforesaid in which the container is of generally cylindrical configuration and is arranged to receive broken-off fastener parts through one of its ends; the closure means is also of generally cylindrical configuration and closely surrounds the container; the container has its discharge aperture located in its cylindrical wall; the closure member normally closes the container aperture and has a corresponding aperture in its cylindrical wall, and is operable by rotary movement of the closure means relative to the container to align the two apertures.

Preferably the orientation of the collector about its cylindrical axis with respect to the installation apparatus is adjustable, thereby to adjust the orientation with respect to the installation apparatus of the container aperture for removal or discharge of broken-off fastener parts.

Preferably the closure means is a snap fit on the container. Preferably the collector is made of transparent material.

A specific embodiment of the invention will now be described by way of example and with reference to the accompanying drawings, in which.

The blind riveting apparatus of this example is a hydro-pneumatic riveting gun for setting breakstem blind rivets of the kind commercially available under the registered Trade Mark "AVEX". Such rivets comprise a body portion or shell with an enlarged head at one end, and a mandrel passing through the shell and having an enlarged head adjacent the other or tail end of the shell and a stem protruding beyond the head end of the shell. The rivet is set by pulling the mandrel relatively to the shell so as to pull the mandrel head into the tail end of the shell thereby to enlarge the latter and form a blind head. Continued pulling on the mandrel stem causes part of it to break off at a preformed breakneck or groove, thereby leaving the remainder of the mandrel not protruding from the head of the shell.

The riveting gun comprises a generally cylindrical head housing 11 carrying at its front end an annular anvil 12 which forms an abutment to support the rivet shell head. Behind the anvil and within the front end of the housing are a pair of jaws 13 which grip the mandrel stem.

The head also contains a hydraulically operated piston and cylinder arrangement (not shown) arranged, when actuated by the gun operator depressing a trigger 14, to cause the jaws 13 to grip the mandrel, retract it forcefully to set the rivet, and thereafter break off the mandrel stem.

The construction and operation of such a riveting gun is well known in the art and will not be described further.

Figure 1:
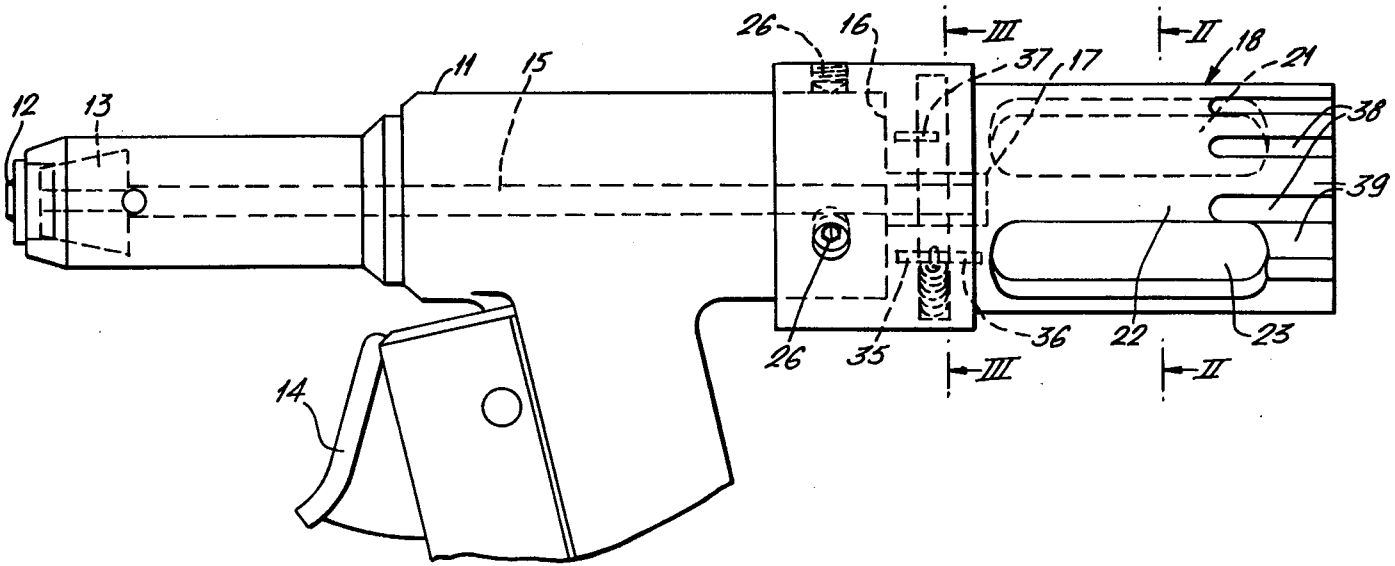
FIG. 1 is a side elevation of part of a blind riveting apparatus to which is attached a mandrel collector.

In this example riveting tool it is arranged that a passage, indicated in broken lines at 15 in FIG. 1, extends from the rear of the jaws 13, through the center of the piston and cylinder arrangement within the head 11, to the rear end face 16 of the head. In this particular example, the passage ends in a tube 17 which protrudes a short distance beyond the rear end of the head.

Figure 2:
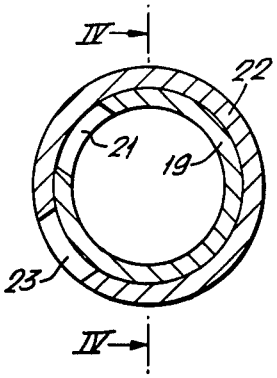
FIGS. 2 and 3 are cross-sections on the lines II—II and III—III, respectively, of FIG. 1.

In this example the mandrel collector 18 is of generally cylindrical form and is attachable by its open front end to the rear end of the head. The collector comprises a generally cylindrical container 20 including a container body 19 with an aperture 21 in its curved wall, and a closure member 22 which is also cylindrical and closely surrounds the container 19. The closure member 22 also has an aperture 23 in its curved wall. The closure member or outer cover 22 is rotatable around the container between a closed position in which the apertures 23,21 are not aligned so that the curved wall of the outer cover closes the aperture 21 in the container as illustrated in FIGS. 1 and 2, and an open position where the outer cover aperture 23 is aligned with the container aperture 21. The outer cover 22 is biassed into the closed position by means of a spring 24.

Figure 3:
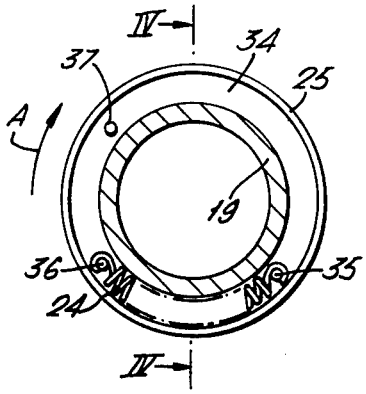
Figure 4:
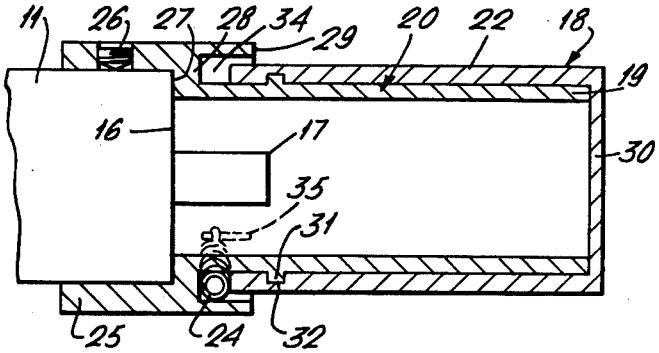
FIG. 4 is an axial section on the lines IV—IV of FIGS. 2 and 3.
Figure 5:
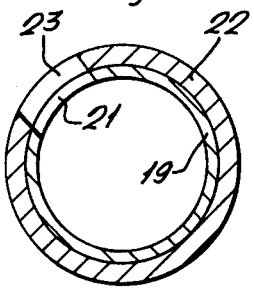
FIG. 5 is similar to FIG. 2 but shows the collector in the open position.

The container 20 includes at its front end a forwardly extending cylindrical socket 25 of a diameter larger than the container body 19 and appropriate to fit over the cylindrical rear end of the gun head. Three set screws 26 are provided, equally spaced around the socket, to securely attach the container to the gun head. The forward end of the container body 19 forms an inwardly extending shoulder 27 on the socket, which abuts the rear face 16 of the gun head. Behind the shoulder 27 a flange 28 joins the rear of the socket 25 to the front end of the container body 19. The outer periphery of the socket is extended rearwardly in a skirt 29 which is spaced radially from the exterior of the front end of the container body 19. The rearward part of this space 34 receives the forwardmost end part of the cylindrical cover 22. The cover 22 is held in engagement on the container body 19 by means of an annular ridge 31 on the exterior of the container body 19 and a corresponding annular groove 32 inside the cover 22. The collector is made of slightly resilient material, e.g. polycarbonate resin (which may also advantageously be transparent), so that the cover 22 can be assembled on to the container body 19 by a snap fit of the groove 32 over the ridge 31, so that the cover 22 is rotatable with respect to the container body about their common axis. The rear end of the container body is open but is permanently closed by the rear end 30 of the cylindrical cover. The remainder of the annular space 34, forwardly of the front end of the cover 22, contains the coiled tension spring 24. One end of this spring is hooked over a pin 35 protruding rearwardly from flange 28 of the container into the space 34, and the other end of the spring being hooked over a pin 36 protruding forwardly from the front end of the cover 22 into the space 34. The length of the spring 24 and the spacing between the pins 35 and 36 are such that when the spring is in its unstressed state the angular orientation of cover 22 with respect to the container body 19 makes the cover aperture 23 completely misaligned with the container aperture 21, so that the latter is closed by the cover 22, as shown in FIGS. 1 and 2. In order to open the collector, the cover 22 is rotated clockwise (as viewed in FIGS. 2, 3 and 5) as illustrated by the arrow A in FIG. 3 against the urging of spring 24 until the aperture 23 is aligned with the aperture 21, as shown in FIG. 5. Rotation of the cover beyond this position is prevented by a stop pin 37, also protruding rearwardly from the container flange 28, against which the cover pin 36 will abut.

In order to facilitate rotation of the cover 22 against the urging of spring 24, the rear end part of the exterior of the cover is provided with a grip in the form of axially extending grooves 38 and lands 39.

The mandrel collector described in the foregoing example is advantageous in a number of ways. It is easily attached to the riveting tool head by the three set screws 26, in any desired angular orientation to position the mandrel discharge aperture 21 wherever required, e.g. facing downwards with respect to the gun, instead of slightly left of vertically upwards as illustrated in the accompanying drawings. The collector automatically catches the broken-off mandrel stems as they are discharged from the rear of the gun head. If the collector is made of transparent material, the operator can easily see when the container needs emptying, and he can easily do this latter by gripping the cover 22 by the grip 38 and 39 and twisting it clockwise with respect to the gun as far as he can, when abutment of the pins 36 and 37 will align apertures 23 and 21. After accumulated mandrel stems have been discharged through the aligned apertures, the cover 22 automatically flicks back to the closed position on release of the grip, due to spring 24.

The invention is not restricted to the details of the foregoing example. For instance, the collector could be incorporated within the structure of the associated riveting apparatus. It can be used with blind riveting apparatus of other varieties, e.g. one in which the rivet mandrel is rotated with respect to the rivet body.

Instead of providing the apertures 21 and 23 in the curved walls of the container and cover, the container 19 could be provided with a rear end wall and the alignable apertures could be provided in this rear end wall and the rear end wall 30 of the cover. This would allow broken-off mandrels to be discharged through the rear end wall of the collector.

We claim:

1. A collector for broken-off fastener parts produced by the operation of fastener-installation apparatus, which collector comprises;

a container attachable to or incorporated in the installation apparatus to receive broken-off fastener parts from the installation apparatus;

the container having an aperture;

closure means normally overlying and closing the aperture;

said closure means being temporarily operable, without detaching the closure means, to allow removal or discharge through the aperture of broken-off parts accumulated in the container.

2. A collector as claimed in claim 1, wherein the closure means is biassed to close the aperture.

3. A collector as claimed in claim 1, wherein the closure member is provided with grip means to facilitate operability thereof.

4. A collector as claimed in claim 1, wherein the closure means is a snap fit on the container.

5. A collector as claimed in claim 1, wherein the collector is made of transparent material.

6. A collector as claimed in claim 1, wherein the closure means is operable by relative sliding movement between the closure means and the container.

7. A collector as claimed in claim 6, wherein the container and the closure means are of generally similar configuration and one is housed within the other, and wherein the closure means is provided with an aperture corresponding to the aperture in the container, the two apertures being normally non-aligned and being brought into alignment by relative sliding movement between the container and the closure member.

8. A collector as claimed in claim 6, wherein the relative sliding movement comprises rotational movement.

9. A collector as claimed in claim 6, wherein the container comprises a cylindrical wall in which the aperture is provided, and in which the closure means also comprises a cylindrical wall.

10. A collector as claimed in claim 6, wherein the container comprises a cylindrical wall in which the aperture is provided, and in which the closure means also comprises a cylindrical wall, the two cylindrical walls being aligned on a common axis, and in which the relative sliding movement comprises relative rotational movement between the container and the closure means about the common axis.

11. A collector as claimed in claim 10, wherein the orientation of the collector about its cylindrical axis with respect to the installation apparatus is adjustable, thereby to adjust the orientation with respect to the installation apparatus of the container aperture for removal or discharge of broken-off fastener parts.

12. A collector as claimed in claim 1, wherein:

the container is of generally cylindrical configuration and is arranged to receive broken-off fastener parts through one of its ends;

the closure means is also of generally cylindrical configuration and closely surrounds the container;

the container has its discharge aperture located in its cylindrical wall;

and the closure member normally closes the container aperture and has a corresponding aperture in its cylindrical wall, and is operable by rotary movement of the closure means relative to the container to align the two apertures.

13. A collector as claimed in claim 12, wherein the orientation of the collector about its cylindrical axis with respect to the installation apparatus is adjustable, thereby to adjust the orientation with respect to the installation apparatus of the container aperture for removal or discharge of broken-off fastener parts.

* * * * *